US007401566B1

(12) United States Patent
Miknich

(10) Patent No.: US 7,401,566 B1
(45) Date of Patent: Jul. 22, 2008

(54) HUNTING BLIND BOAT COVER

(76) Inventor: Charles Miknich, 3600 Taiga Dr., Anchorage, AK (US) 99516

( * ) Notice: Subject to any disclaimer, the term of this patent is extended or adjusted under 35 U.S.C. 154(b) by 1285 days.

(21) Appl. No.: 10/283,820

(22) Filed: Oct. 29, 2002

(51) Int. Cl.
*B63B 35/00* (2006.01)

(52) U.S. Cl. ..... 114/351; 114/361

(58) Field of Classification Search ..... 114/349, 114/351, 361
See application file for complete search history.

(56) References Cited

U.S. PATENT DOCUMENTS 1,295,893 A * 3/1919 Hartz ..... 114/349
3,280,785 A * 10/1966 Mycroft ..... 114/344
3,698,409 A * 10/1972 Koontz et al. ..... 114/361
4,070,722 A * 1/1978 Sutherland ..... 114/351

* cited by examiner

*Primary Examiner*—Sherman Basinger
(74) *Attorney, Agent, or Firm*—Michael J. Tavella

(57) ABSTRACT

A hard shell cover hunting blind for a boat that may be left on while transporting the boat to the water. The shell has an open back that allows full visibility when moving. A camouflage covering is secured to a hoop in the back that can be quickly dropped down. Two large clamshell doors are placed in the front. The shell has a sliding door that opens up the sides of the blind. This provides easy access into and out of the boat as well as for placing decoys, etc. In addition, there is a curved top that is mounted on slides. This top can be pulled to either side to provide a full 360° filed of vision and a large shooting port. No tools are needed to operate the system of doors or to remove and install the clamshell front pieces.

11 Claims, 20 Drawing Sheets

HUNTING BLIND BOAT COVER

CROSS REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the Invention

This invention relates to hunting blinds and particularly to hunting blinds that form a boat cover.

2. Description of the Prior Art

Hunting blinds have been used for years to aid hunters in concealing themselves from the prey. Blinds are often built on land for hunting both land-based animals and for hunting birds, such as ducks. Often these blinds are made of local materials to blend in with the surroundings. Although these blinds are quite useful, if a hunter or group of hunters must access the blind by boat, it seems inconvenient to have to use the boat to get to the site and then establish a blind on shore. A better way would be to use the boat itself for the blind. To that end, several devices have been patented in which a boat is used as a hunting blind.

Examples of these devices are found in the following U.S. Pat. No. 2,889,839 to Sheridan Jr. discloses a duck blind for boats This blind is a tent-like structure that is made of a canvas type material. Portholes are provided for viewing and the side walls can open for firing. Although this device can work, it is best assembled in the field, rather then being transported in place. It uses flaps and straps that may be cumbersome to open quickly under certain conditions. U.S. Pat. No. 4,070,722 teaches a blind that has a hard superstructure. The superstructure covers most of the entire boat. The blind has a raised center portion with view ports. It also has a number of hatches that are used to access the blind and to permit shooting. This device is also useful. However, it is limited in use because of the small view ports. Moreover, hunters have access for firing through ports that are not large. Finally, the front of the boat is covered except for a small port in front. This reduces visibility when operating the boat. The driver must stand up through one of the ports to really see clearly. Even then, the view is obscured by the blind. U.S. Pat. No. 4,106,145 teaches a large boat cover that is used as a blind. The cover has a metal frame and is covered with a canvas type material. The cover does not completely enclose the hunter; portion in the front is open for viewing. When the hunter is ready to shoot, the cover is partially retracted and the hunter is free to shoot. The problem with this design is that it is limited for use to one hunter. Moreover, the hunter's view and firing range is limited to one direction. U.S. Pat. No. 4,300,253 discloses another type of tent blind that can be easily assembled in the field. It has a framework over which, pieces of canvas like material are placed. The tent has side walls that can be dropped quickly as needed. The problem with is design is that the side walls can fall into the boat or into the water. Although the ability to get out of the way is an asset, once they are down, they may become wet or otherwise difficult to handle. U.S. Pat. No. 4,593,641 teaches a universal frame for a boat blind. This frame is collapsible and can be set up quickly. The frame is covered by a camouflage tarp that has openings for viewing and shooting. U.S. Pat. No. 4,671,203 teaches another tent-like blind for boats. In this design, a frame having multiple sections is used. The sections are covered with different panels of material that can be used as covers and as door. Camouflage windows are also provided for viewing. Finally, elastic strips are provided to allow brush to be used to further camouflage the blind. The branches and leaves are inserted in the elastic bands as desired. Although this design is versatile, it is complex and not quickly assembled. Moreover, there are many fittings and zippers that can become worn and damaged after use, which require a lot of maintenance. U.S. Pat. No. 5,615,633 teaches a blind for boats that has a hard shell. A number of elastic bands are placed about the shell for attaching branches and other items for camouflage. The top center of the shell is open with an elevated top. Hatches are provided for entry and exit and user view through the top opening. U.S. Pat. No. 6,129,034 teaches a boat cover that can be used as a blind that uses a number of curved ribs that are spaces apart along the gunwales of the boat. A soft canvas-like cover is then placed over the frame. Other examples of blinds are found in U.S. Pat. Nos. 6,260,505, 4,979,456, 5,458,079, D392,244, 5,887,539, and 3,698,409.

Although there are many designs for boat hunting blinds, they suffer from the same problems: the soft tent style designs typically must be assembled in the field. The hard-sided models tend to provide limited visibility while operating the boat and are also cramped and low. Moreover, all of the designs do not provide adequate opening for shooting and other movements.

BRIEF DESCRIPTION OF THE INVENTION

The instant invention solves all of these problems. It is a hard shell cover for a boat that may be left on while transporting the boat to the water. The shell has an open back that allows full visibility when moving. A camouflage covering is secured to a hoop in the back that can be quickly dropped down. This spreads the camouflage netting over the back of the boat and completely covers the engine. Two large clamshell doors are placed in the front. These doors are closed when transporting the boat on the highway. They are removed and placed on holders in the stern when operating the boat on the water. Once the boat is in place, the clamshell doors can be replaced in the bow and closed. View ports are provided in the clamshells for visibility when the boat is used as a blind. The shell has a sliding door that opens up the sides of the blind. This provides easy access into and out of the boat as well as for placing decoys, etc. In addition, there is a curved top that is mounted on slides. This top can be pulled to either side to provide a full 360° field of vision and a large shooting port. The top is also open when traveling on the water. The entire structure can be easily removed from the boat as needed. Finally, no tools are needed to operate the system of doors or to remove and install the clamshell front pieces. Finally, the structure is designed to be easily camouflaged to match a given area's vegetation.

DETAILED DESCRIPTION OF THE INVENTION

Figure 5:
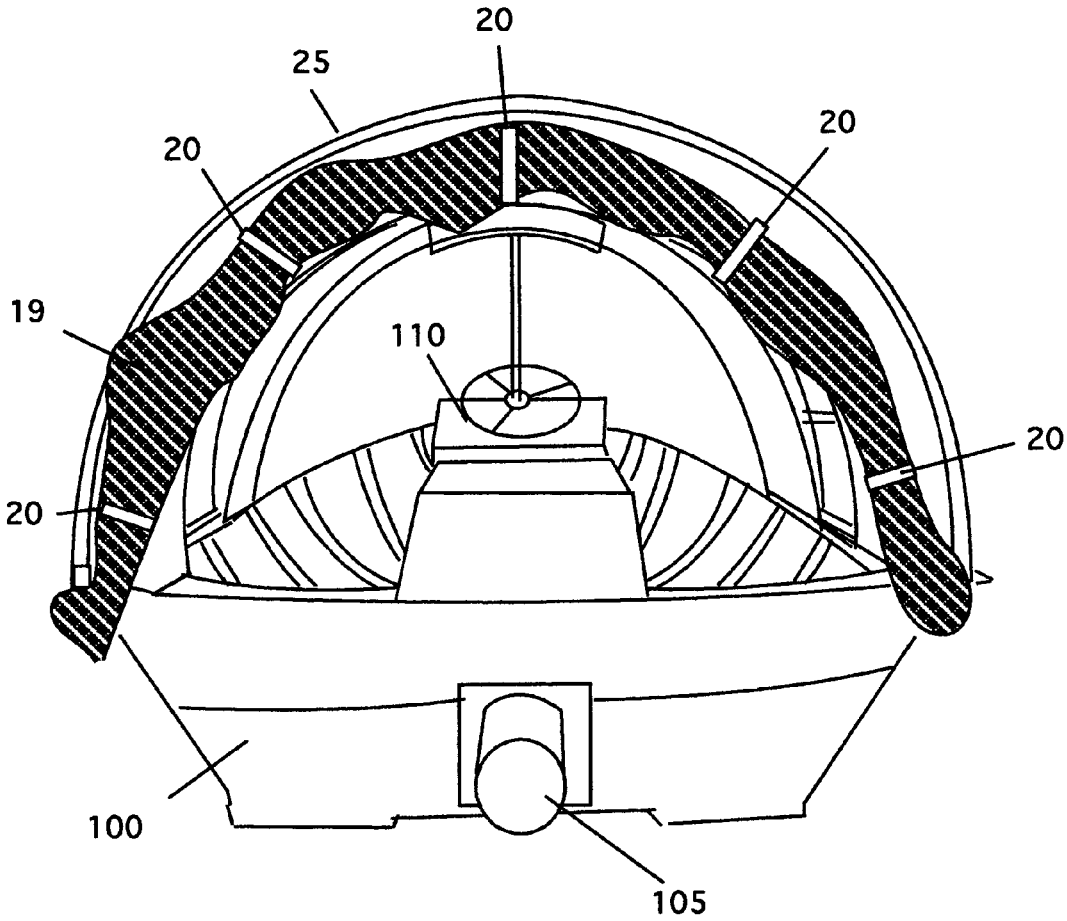
FIG. 5 is a rear view of a boat showing the invention installed and the camouflage netting in the stored position.

The invention has three basic modes of operation: water transportation, stationary blind, and ground transportation. Each of these modes will be discussed below. Before discussing the specific aspects of these modes, some general comments will be made. Referring to FIG. 5, the invention 1 is designed to be placed on a small boat hull 100 as shown. This hull can be any type of small watercraft that is powered by an outboard or inboard motor 105. Typically, these vessels have a steering station 110 where the operator can stand to steer the boat while moving it to a desired location on the water.

Figure 1:
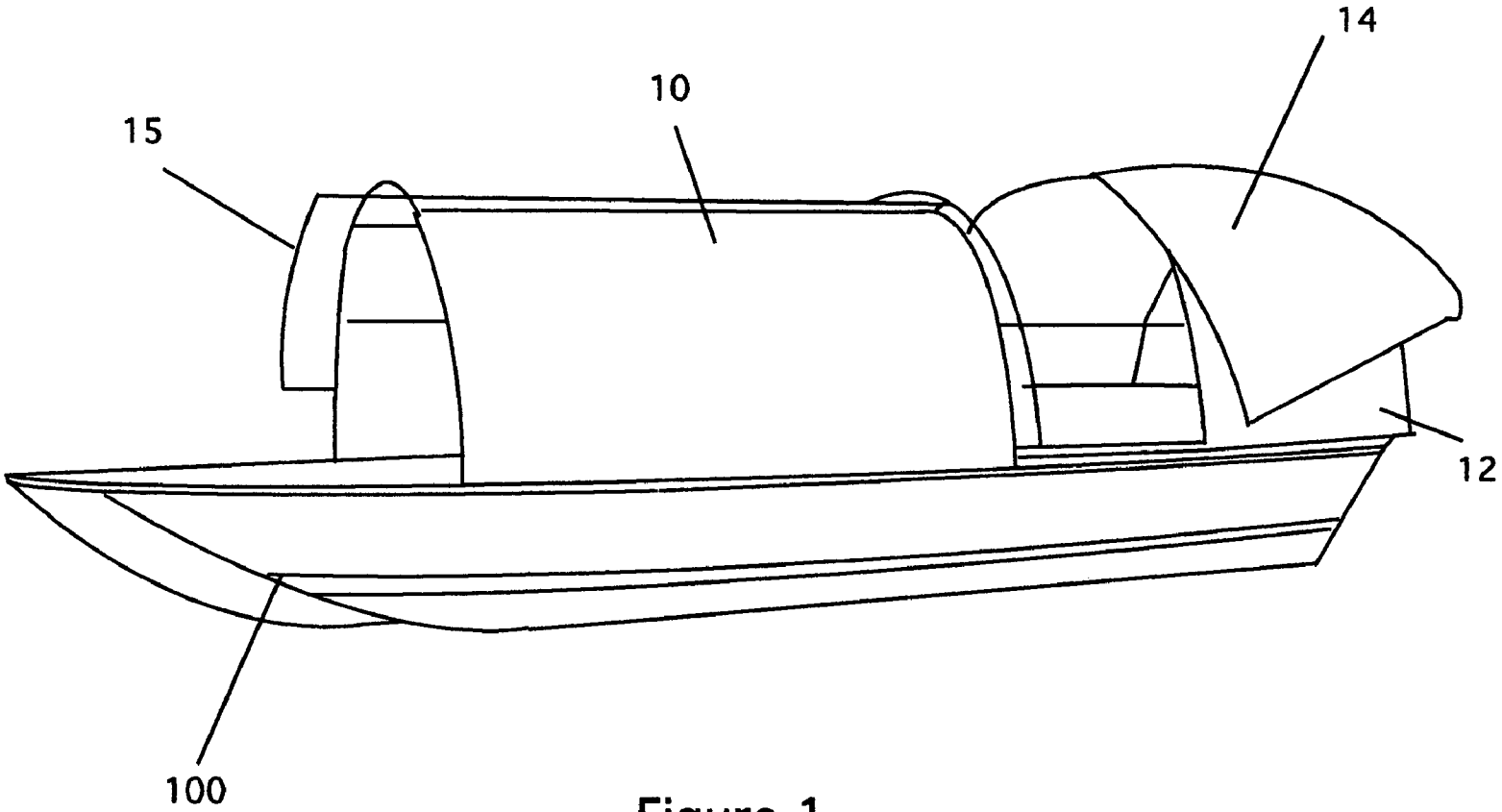
FIG. 1 is a front perspective view of a boat showing the invention installed in the water transport mode.

Referring now to FIG. 1, a perspective view of the invention showing the invention 1 in the water transportation mode is shown. In this figure, the invention 1 has a shell 10 that forms the body of the center blind. The structure of the blind shell is discussed below. At the stern of the boat there is a rear blind shell 10. The rear blind shell is covered by a sliding door 12. This door is shown open. Two clamshell bow covers 14 are stored at the stern of the boat in the water transport mode. Normally, these covers fit over the bow, as discussed below. At the top of the center blind is a sliding top cover 15. The top cover 15 is designed to slide on the curved rods, as discussed below. In FIG. 1, the curved top 15 is slid down to the side. This allows an operator to stand at the steering station 110 to operate the vessel.

Figure 2:
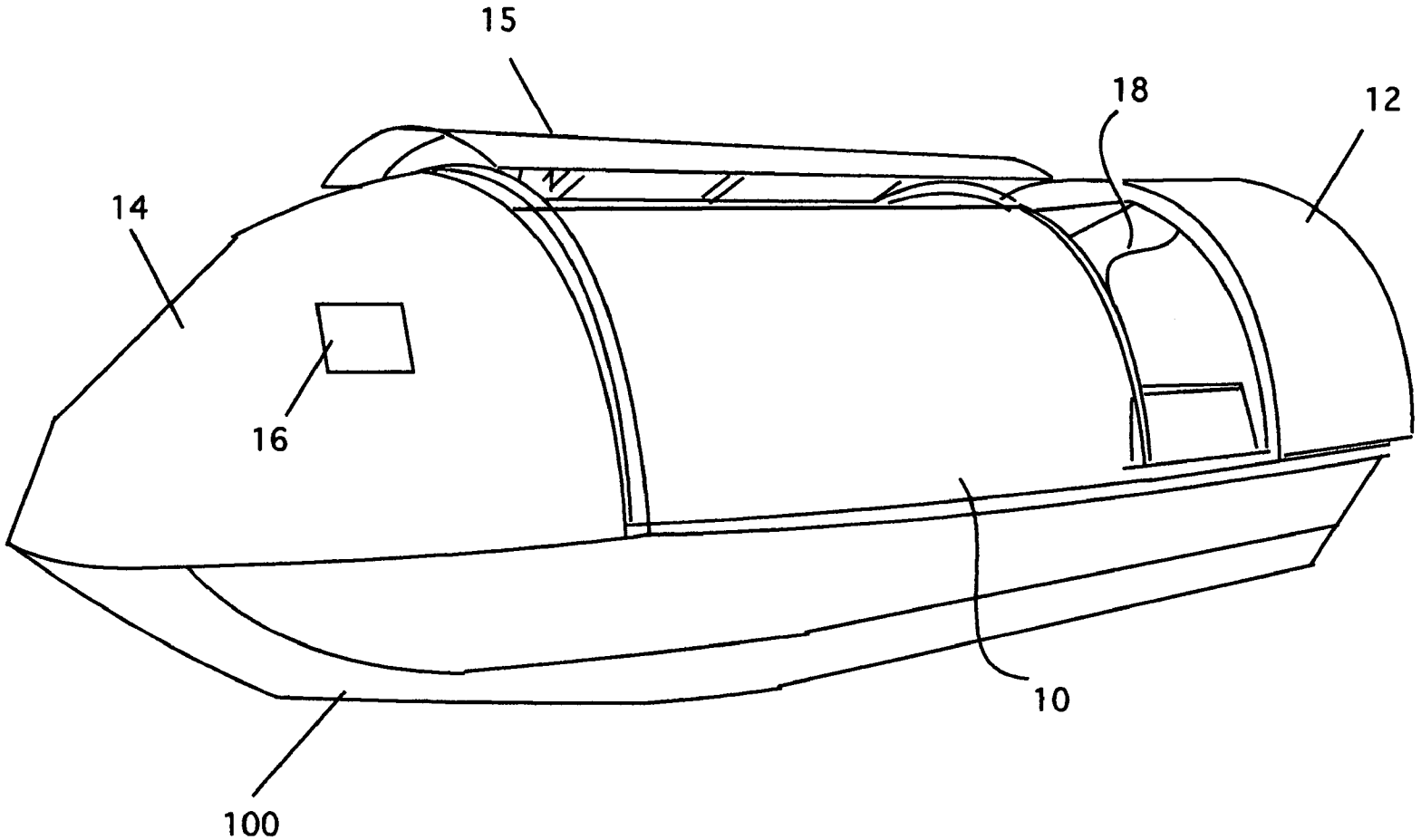
FIG. 2 is a front perspective view of a boat showing the invention installed in the partially closed blind mode.

FIG. 2 is a front perspective view of a boat showing the invention 1 installed in the partially closed blind mode. In this view, the blind is not fully operational. This is the situation where the hunters have arrived at the desired location and have begun to set up the blind. The clamshell covers 14 are mounted on the bow and secured in the closed position (discussed in more detail below). Note that the clamshell covers have viewing panels 16 so that forward view can be obtained while the blind is closed. Note also that in this mode, the top cover 15 is slid up to the closed position. Note that the top cover can be slip to any angle on either side of the boat for better firing positions (as discussed below). Note also that there is a gap 18 between the center blind 10 and the aft blind 10*a*. This gap 18 forms an access opening for the boat. In the preferred embodiment, there is an access opening on both sides of the vessel. The sliding door 12 is provided to close the access openings for the fully closed blind position.

Figure 3:
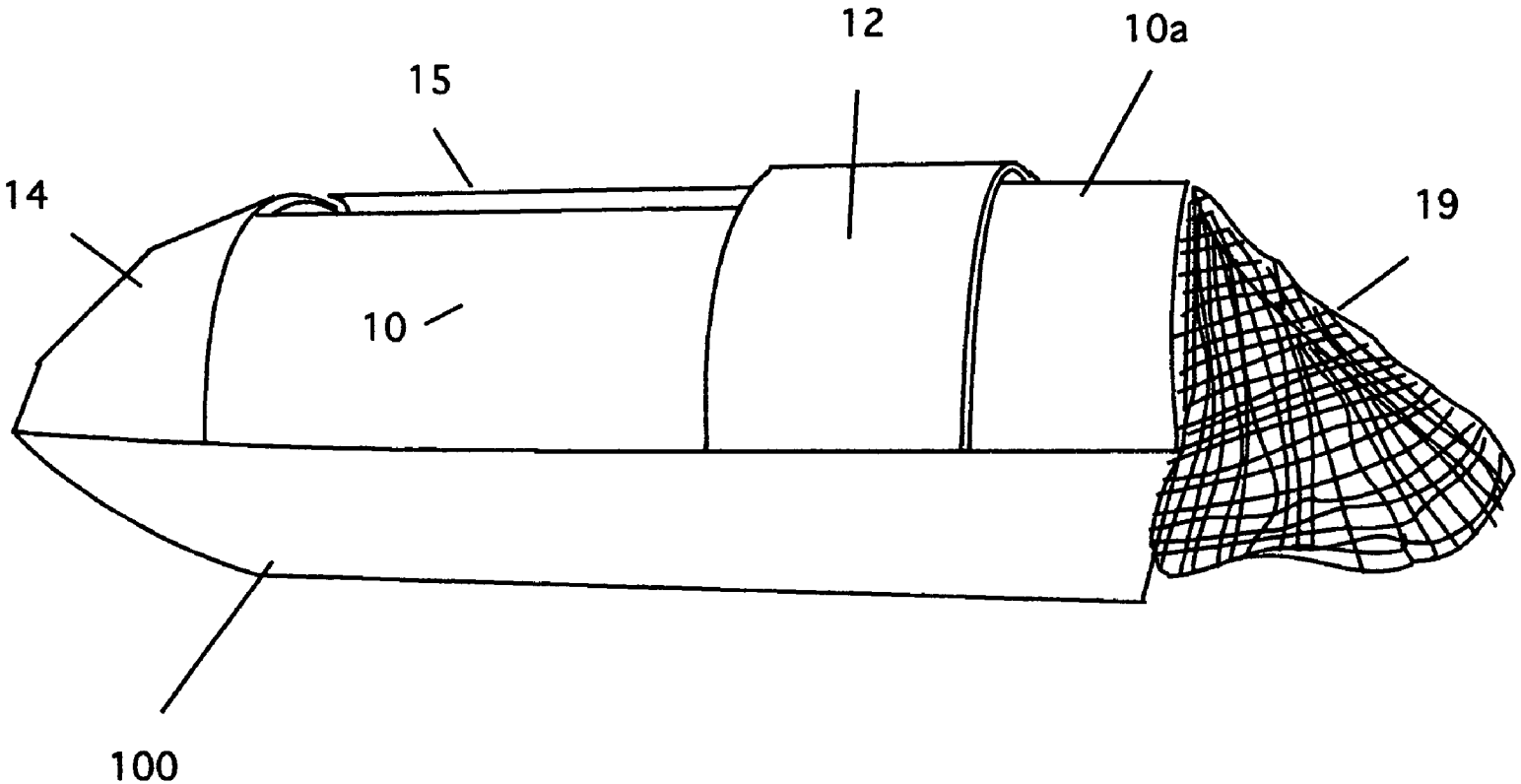
FIG. 3 is a rear perspective view of a boat showing the invention installed in the closed blind mode.

FIG. 3 is a rear perspective view of a boat showing the invention installed in the closed blind mode. Here, the preparations for the hunting are completed. The boat is secured or anchored, the clamshell covers 14 are closed and the sliding door 12 is closed and secured. This view shows the top cover 15 slid down on the opposite side of the boat. This position allows the hunters shooting positions through the open top of the boat in any direction. When the top cover is open, a 360° field of vision is provided. Note also that in the fully closed blind position, a camouflage netting 19 is lowered and spreads out over the motor and stern of the boat by means of a hinged hoop (not shown). This netting 19 ensures that that the stern of the vessel is completely hidden in the hunting mode.

Figure 4:
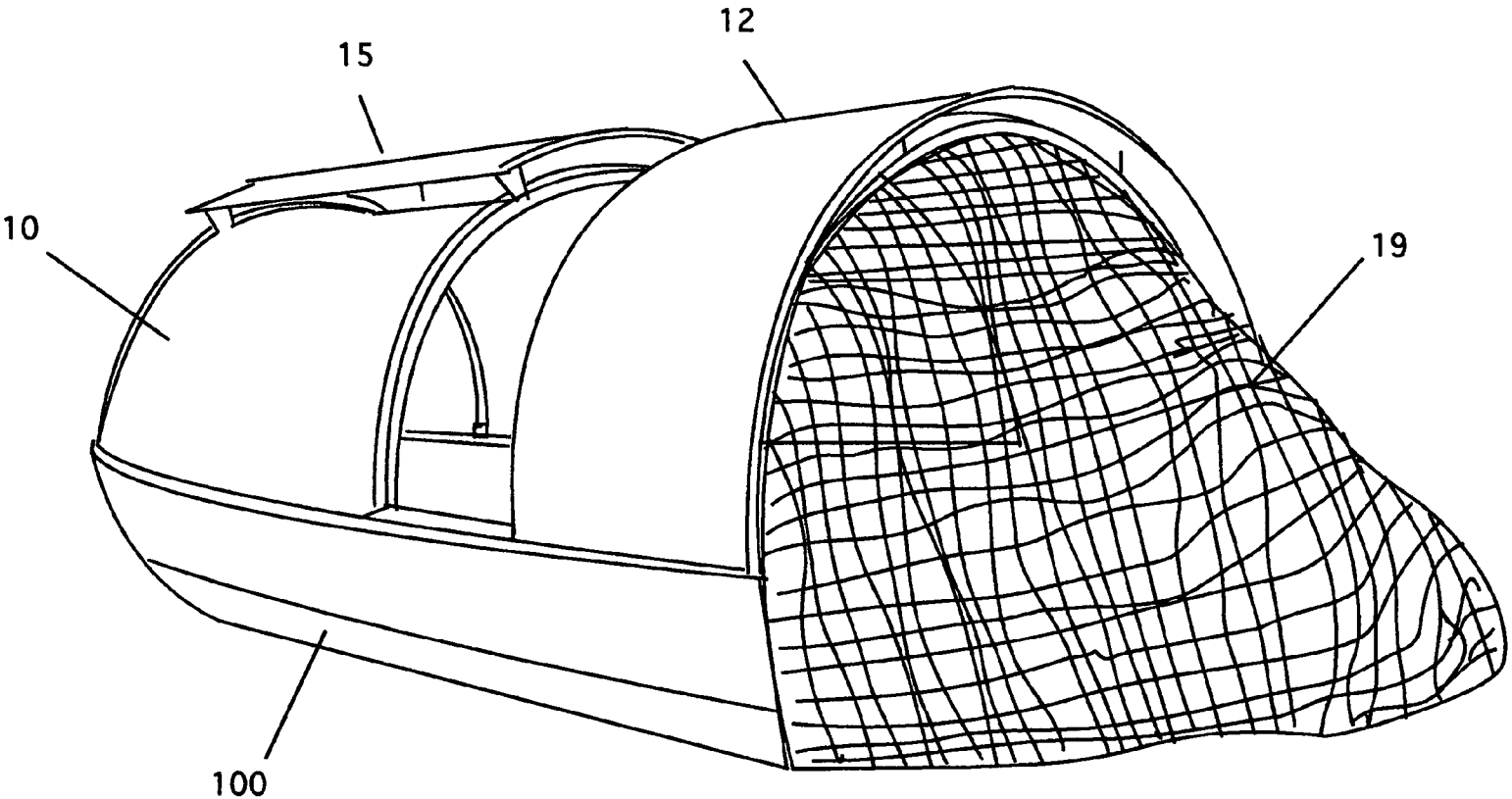
FIG. 4 is a rear perspective view of a boat showing the invention installed in the closed blind mode with a side access door open.

FIG. 4 is a rear perspective view of a boat showing the invention installed in the semi-closed blind mode of FIG. 2. Note also the arrangement of the camouflage netting 19 in this view.

FIG. 5 is a rear view of a boat showing the invention installed and the camouflage netting 19 in the stored position. As shown, the netting 19 is rolled up and held in place with straps 20. The netting is rolled for water transport and ground transport.

Figure 6:
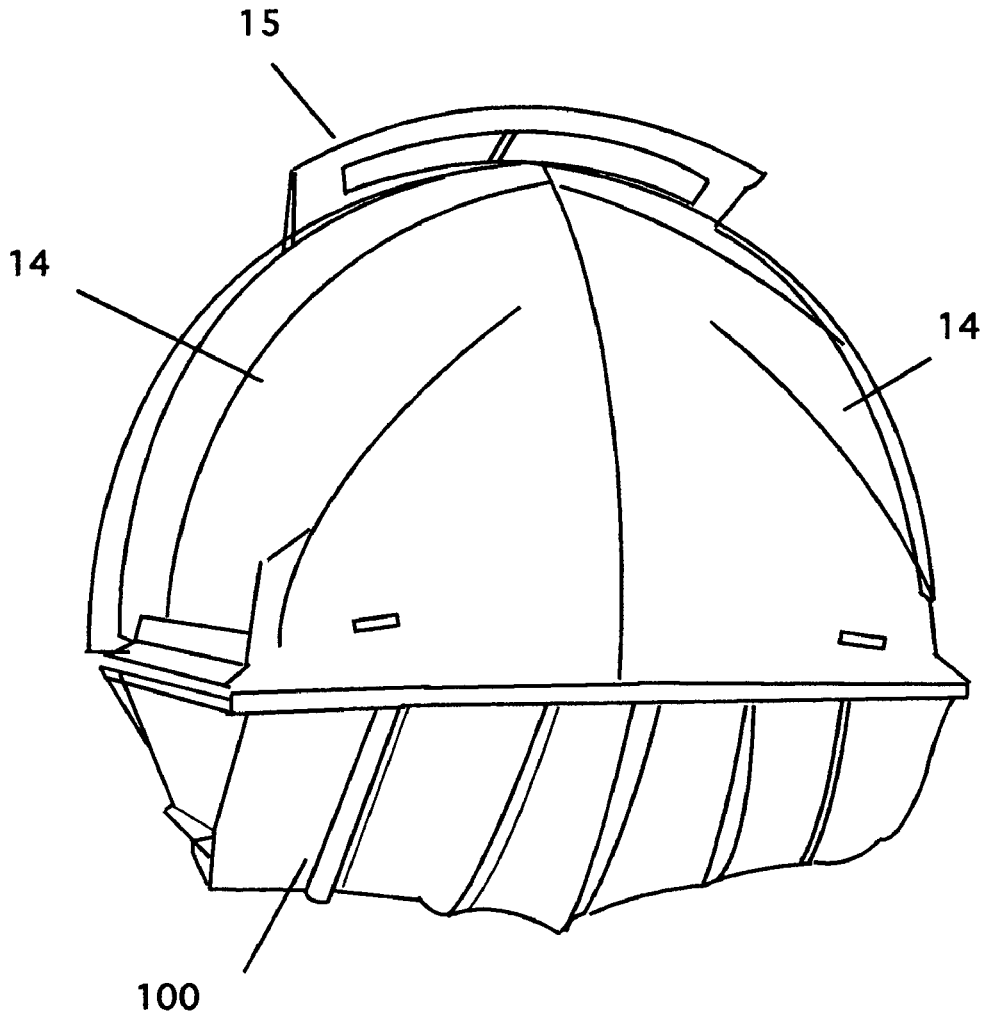
FIG. 6 is a front perspective view of a boat with the clamshell covers in the closed position.

FIG. 6 is a front perspective view of a boat with the clamshell covers 14 in the closed position. In this view, the top cover 15 is shown closed. This view shows the configuration for ground transport. In this mode, the covers are closed and the boat is mounted on a trailer (not shown). In this way, the boat and contents are protected during ground transport of the vessel.

Figure 7:
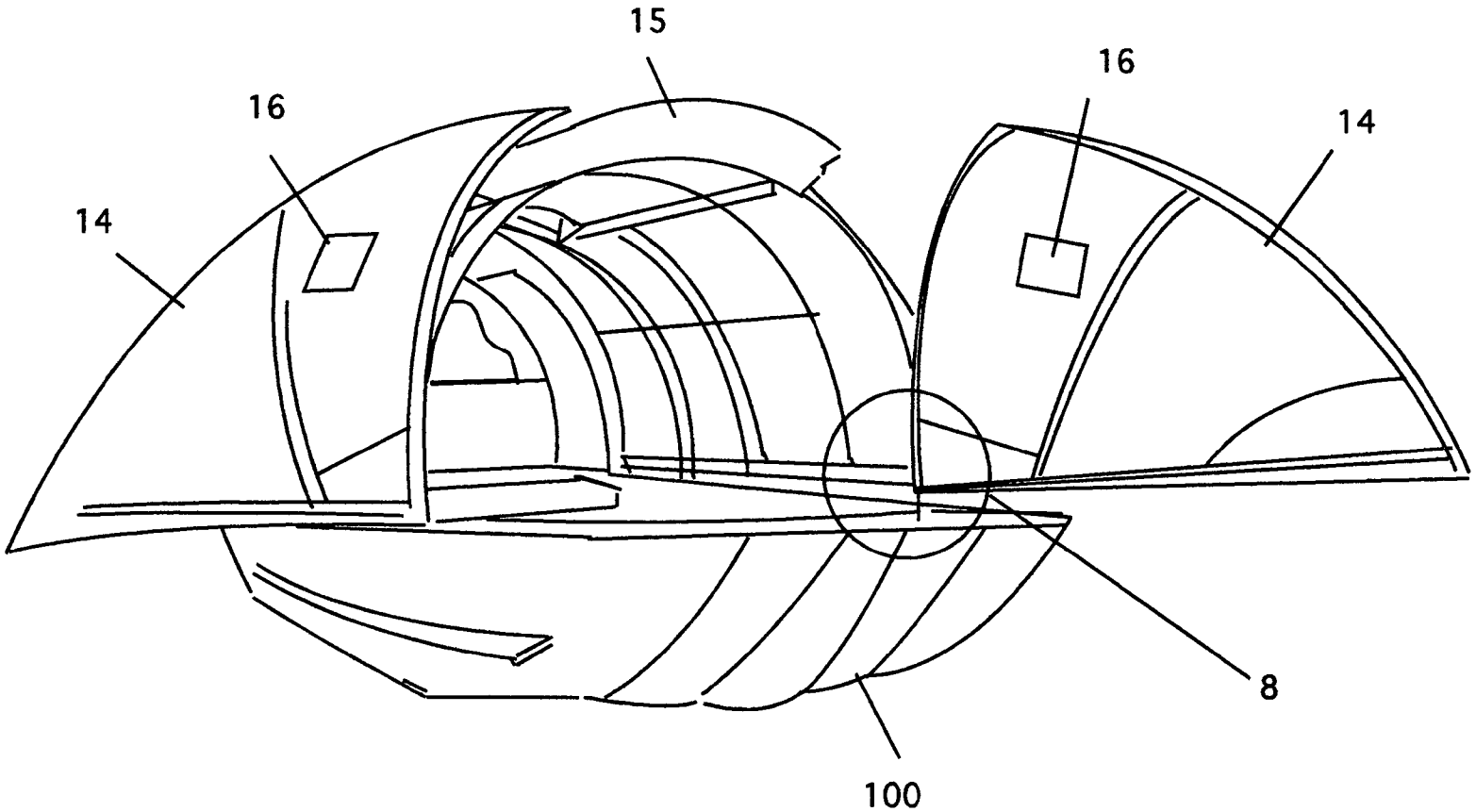
FIG. 7 is a front perspective view of a boat with the clamshell covers in the open position.

FIG. 7 is a front perspective view of a boat with the clamshell covers in the open position. Here, the clamshell covers 14 are mounted on the bow of the boat but are opened. This is done when the covers are removed to be placed on the stern for water transport or when they are replaced for use as a blind. Note the two dog-viewing ports 16. In the preferred embodiment, these ports are solid covers that hinge inward, as discussed below. Of course, any suitable type access type viewing port can be used.

Figure 8:
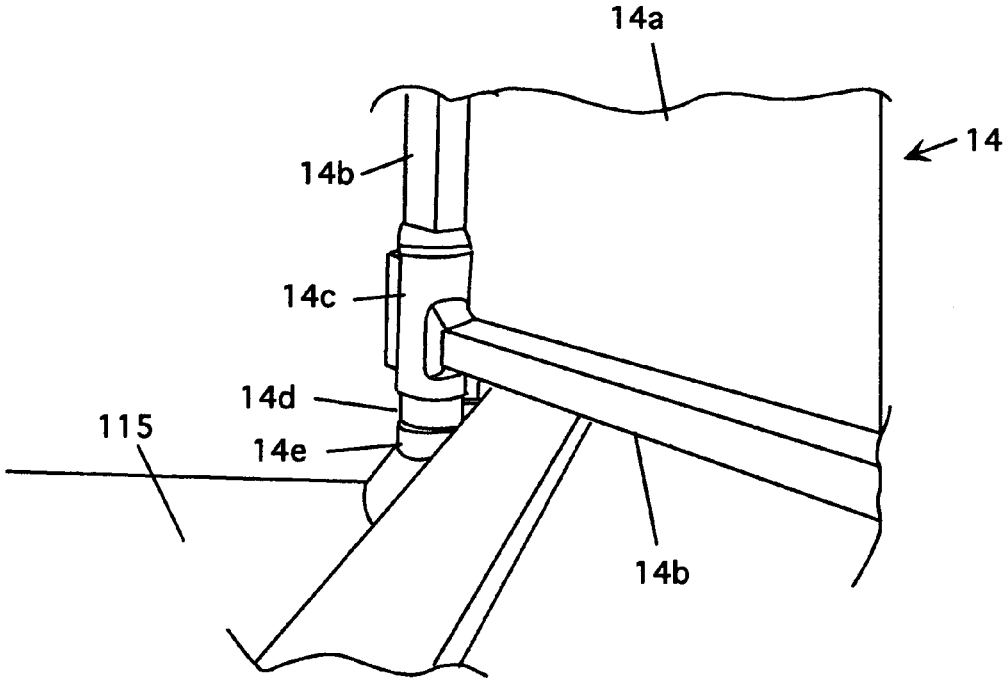
FIG. 8 is an inset detail view of the forward clamshell cover hinge of FIG. 7.

FIG. 8 shows an inset view of the details of the clamshell cover. Each clamshell cover 14 is made up a metal skin 14*a* that is reinforced by frame members 14*b*. At the base of each clamshell is a hinge or pivot 14*c*. The hinge has a barrel and a small hollow cylinder 14*d* that sits on a post (not shown) that is attached to the hinge base 14*e*. The hinge base 14*e* is secured to the fore deck 115 of the boat 100. In this way, the clamshell covers 14 can be placed on to the bow of the boat. A mounting device is secured to each side of the stern to hold the clamshell covers when they are stored there.

Figure 9:
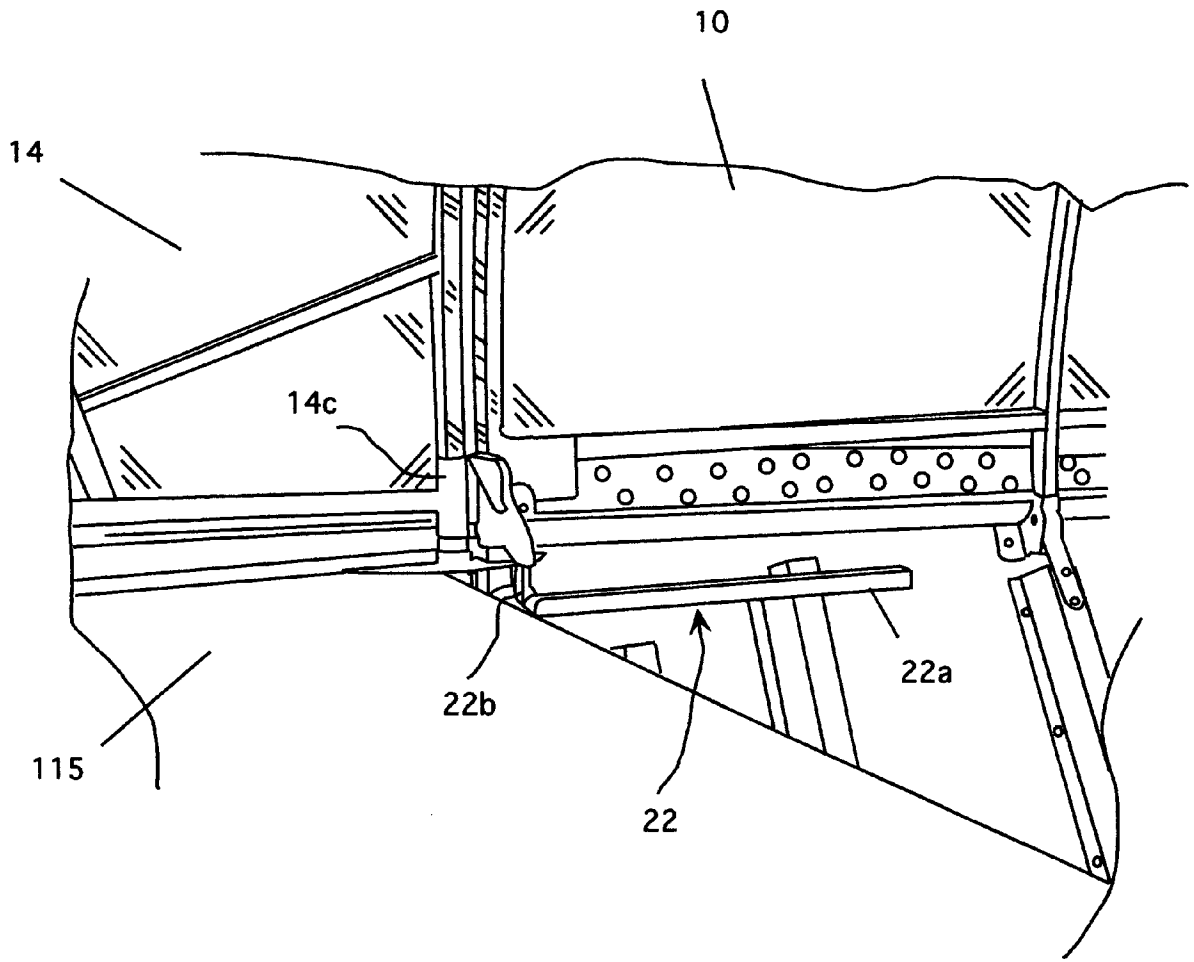
FIG. 9 is a detail view of the forward door showing the operating handle installed.
Figure 9A:
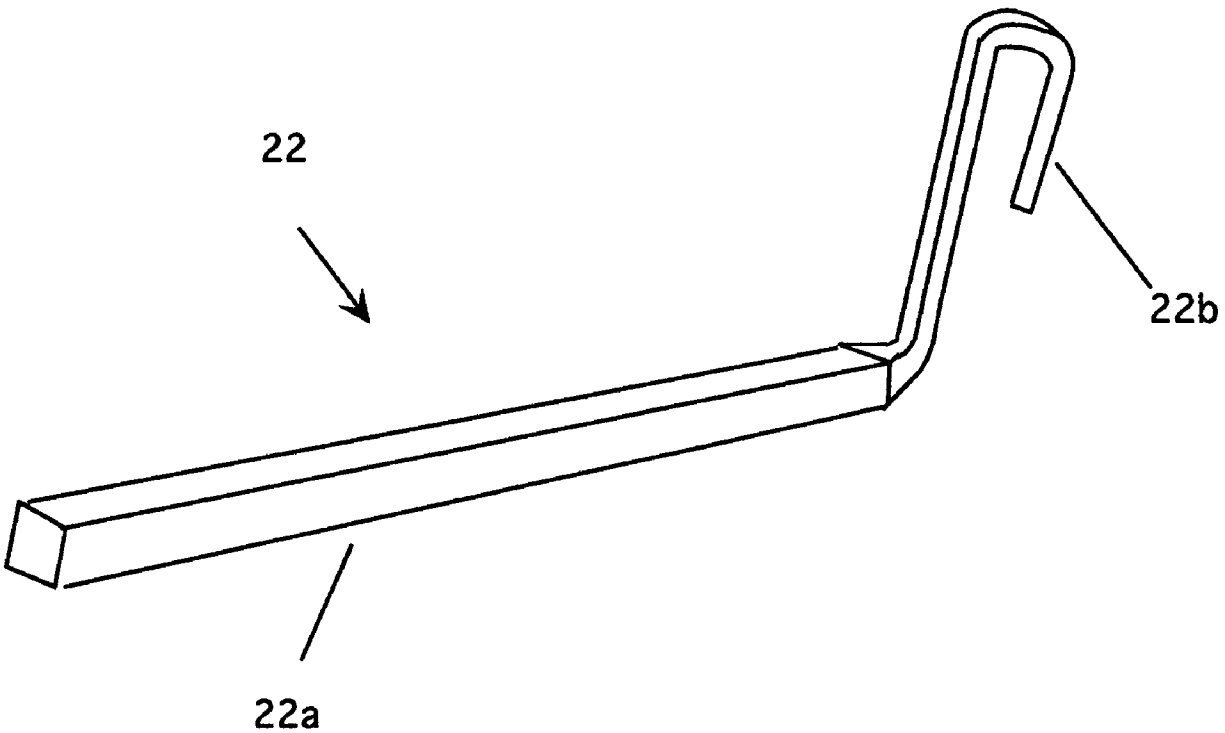
FIG. 9*a* is a detail of the operating handle.

FIG. 9 is a detail view of the forward door showing the operating handle installed. FIG. 9*a* is a detail of the operating handle itself. The operating handle 22 has a handle portion 22*a* and a hook portion 22*b*. The hook portion is designed to fit into a pocket at the back of the hinge 14*c*. The hook fits into the pocket and the handle 22*a* extends back. The user than then grip the handle to open and close the clamshell doors safely when they are installed.

Figure 10:
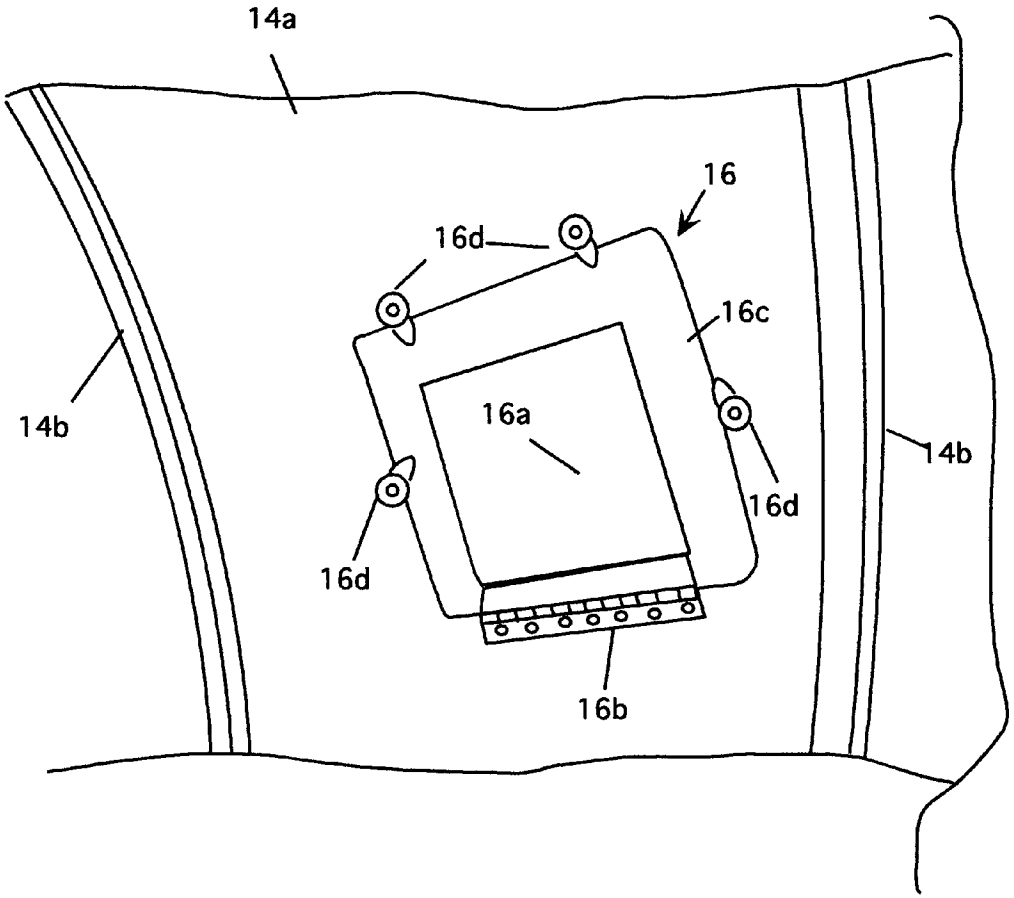
FIG. 10 is a detail of a closed dog viewing port mounted in the clamshell covers.
Figure 11:
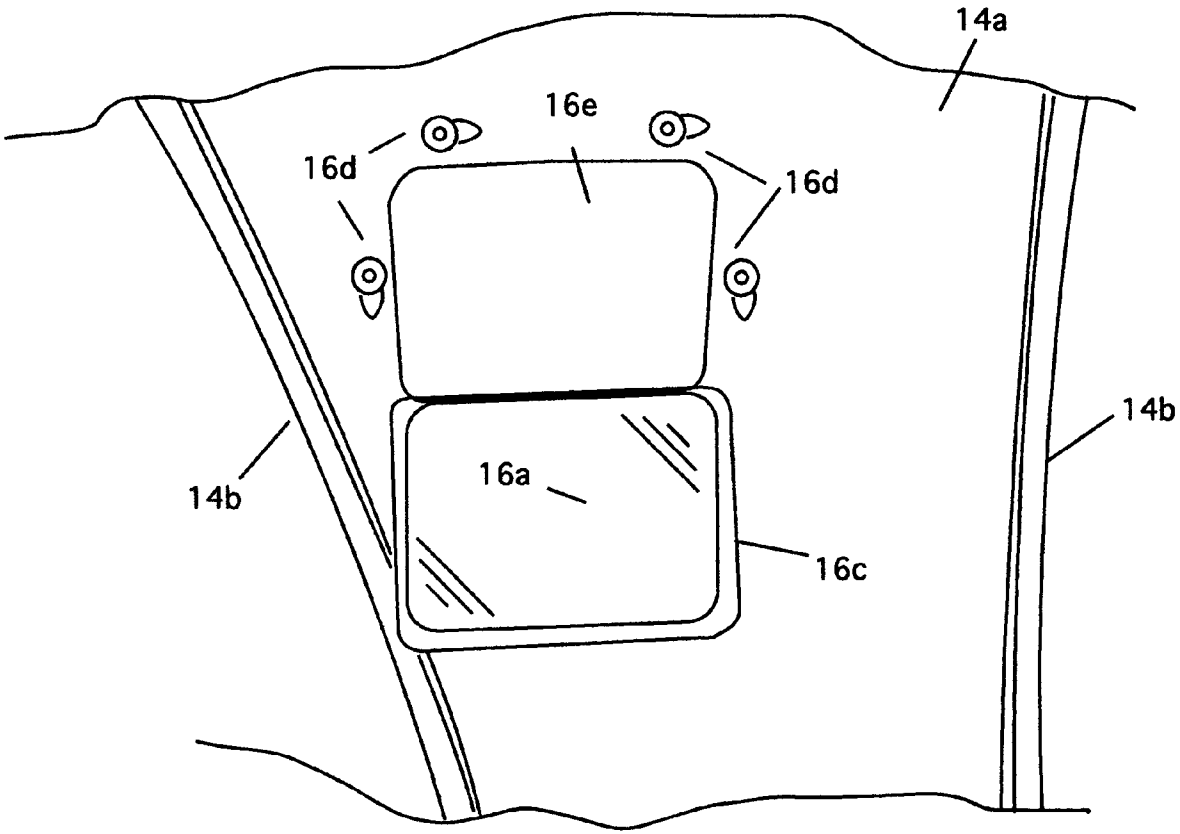
FIG. 11 is a detail of an open dog viewing port mounted in the clamshell covers.

FIG. 10 is a detail of a closed dog viewing port 16 mounted in the clamshell covers 14. In the preferred embodiment, these doors can be open to allow dog viewing through the closed clamshell doors when in the blind mode. Although any designs of doors may be used, one example is shown. In this design a reinforced flexible member 16*a* is secured to a hinge 16*b* that is also attached to the skin 14*a* of the clamshell doors. The flexible member 16*a* is reinforced by a band of metal 16*c* as shown. A number of screw latches 16*d* are spaced around the door as shown. The latches have a lip that is turned over the door to hold it closed and are turned back to open the door. FIG. 11 is a detail of an open dog viewing port mounted in the clamshell covers. In this view, the latches 16*d* are turned away from the door and the door is opened, showing the open space 16*e* for viewing.

Figure 12:
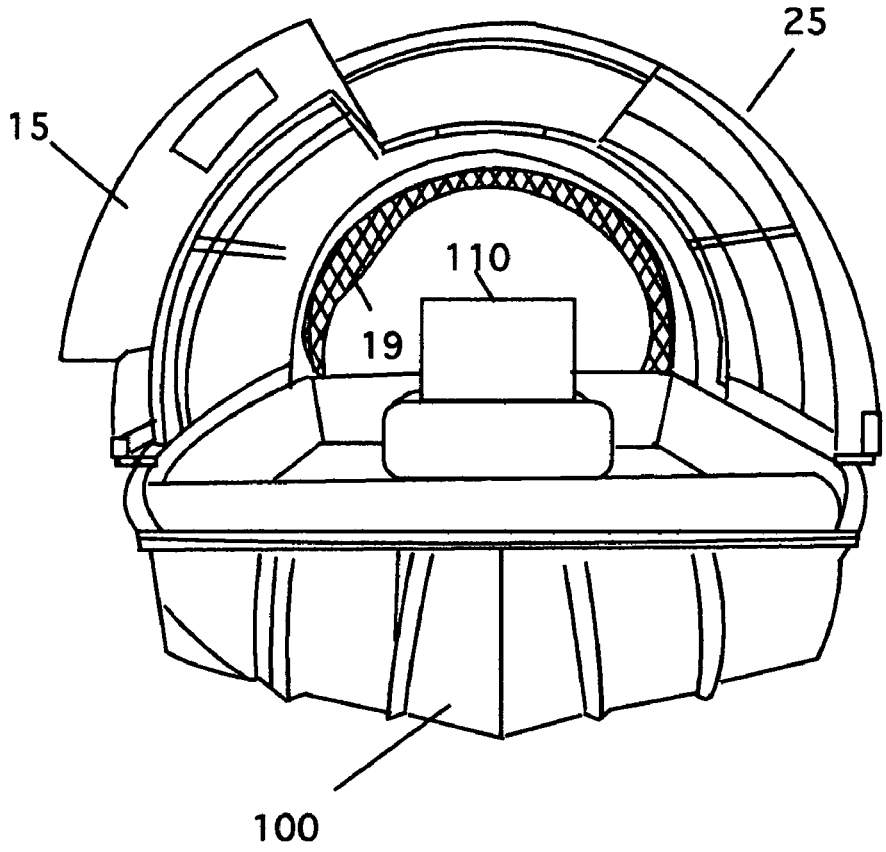
FIG. 12 is a front view of a boat with the invention installed, with the clamshell covers removed and the top sliding door open.

FIG. 12 is a front view of a boat with the invention installed, with the front doors removed and the top sliding door open and the camouflage netting rolled. This shows a bow view of the water transportation mode. As shown, the operator has a clear view out of the bow and can stand and look through the open top as the top cover is slid off to one side.

Figure 13:
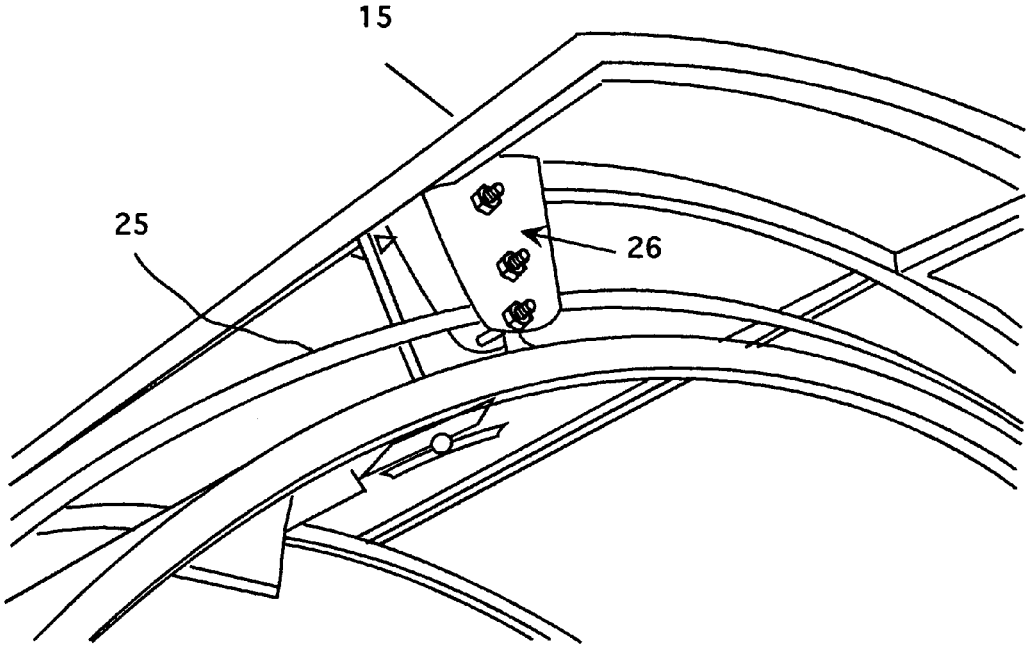
FIG. 13 is a detail view of the top sliding door guide track and operating wheel system.
Figure 14:
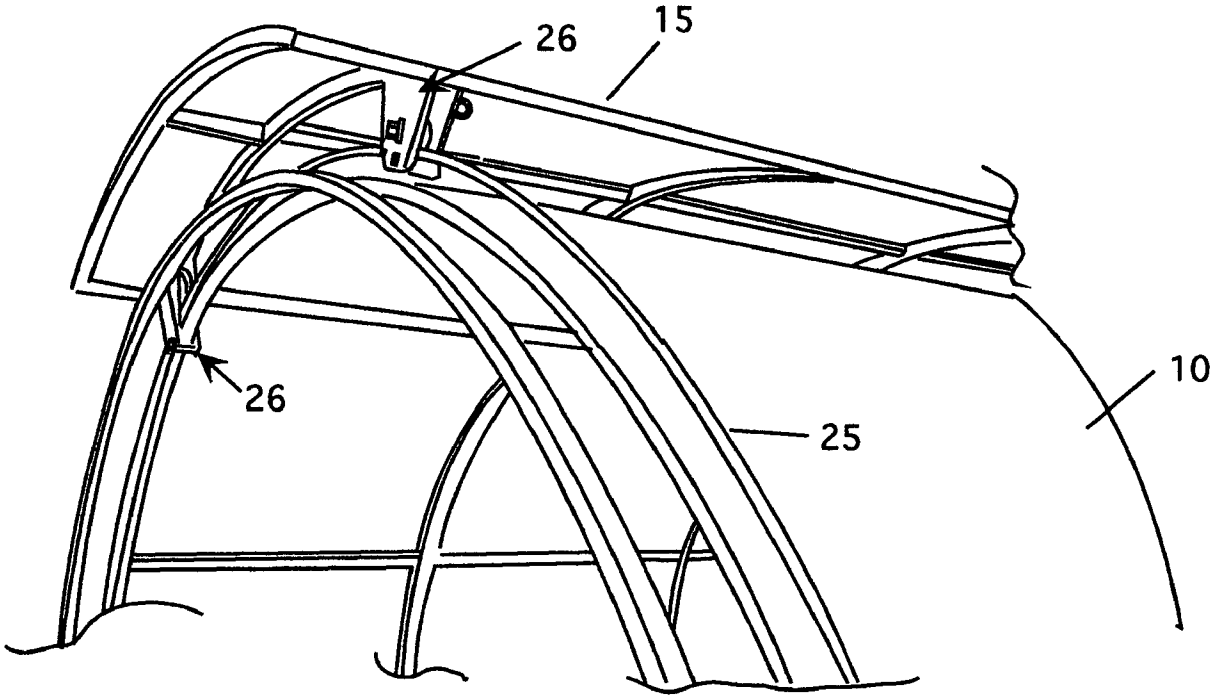
FIG. 14 is another detail view of the top sliding door guide track and operating wheel system.
Figure 16:
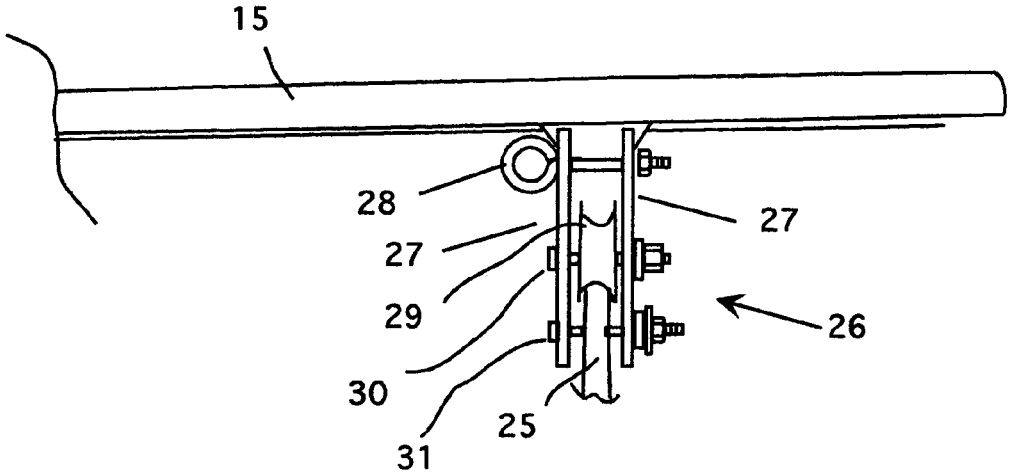
FIG. 16 is a front detail view of the top sliding door wheel system.

FIG. 13 is a detail view of the top sliding door guide track and operating wheel system. The top sliding door 15 is designed to slide in either direction. As noted above, it is opened for boat water transport and is closed for road transport. The top sliding door slides on a pair of round hoops 25 one hoop 25 is placed under the front of the top sliding door and the other is placed at the rear. These hoops 25 extend from gunwale to gunwale. See e.g., FIG. 12. Four wheel assemblies 26 are secured to the top sliding door. FIG. 13 shows one of the wheel assemblies attached to the door and the forward hoop. FIG. 16 is a front detail view of the top sliding door wheel assembly 26. Each assembly has two side plates 27 that are secured to the top sliding door by welding and by an eyebolt and nut 28. The eyebolt is used to attach items, such as a bungee cord, for example. A pulley 29 is secured in the assembly by a bolt and nut 30 as shown. The pulley is placed above the hoop 25. A second nut and bolt 31 are installed in the bottom of the side plates below the hoop 25. This bolt and nut assembly is used to keep the assembly on the hoop. As mentioned above, there are four of these assemblies installed at the corners of the top sliding door. FIG. 14 is another detail view of the top sliding door guide track and operating wheel system that shows two of the assemblies installed on the forward hoop 25.

Figure 15:
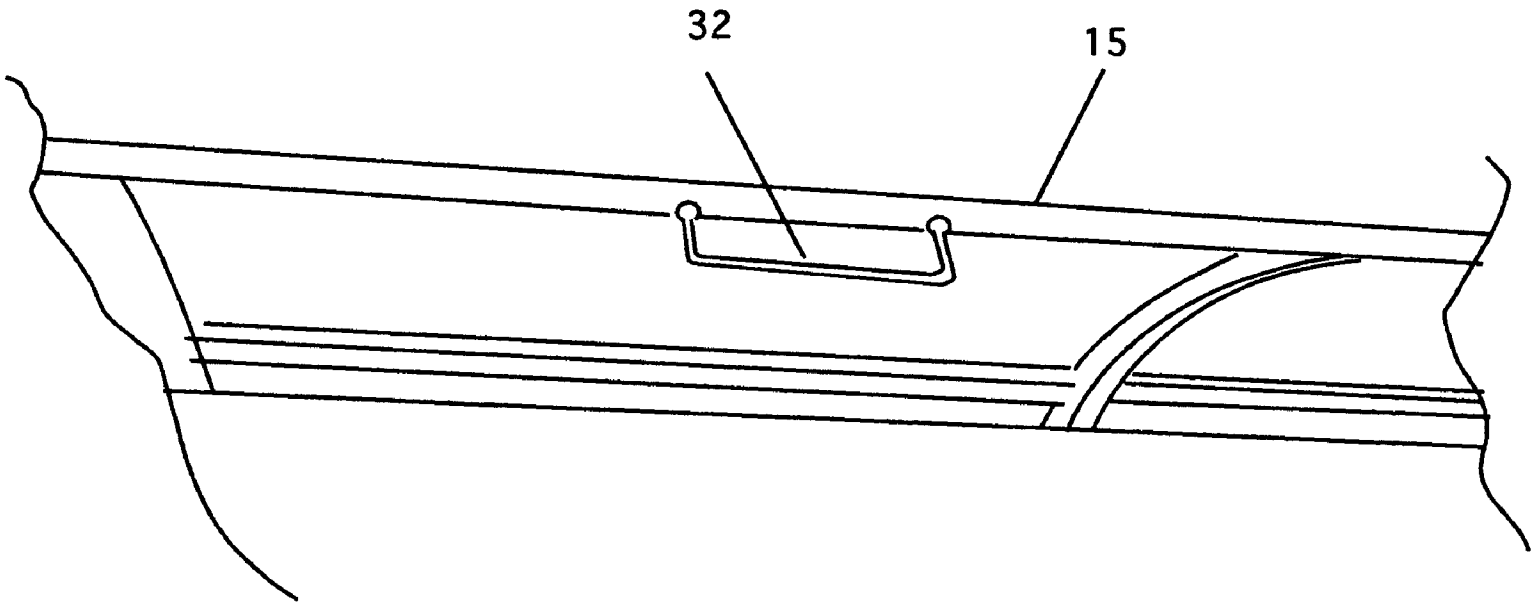
FIG. 15 is a detail view of a handle on the top sliding door used for opening and closing the top sliding door.

As discussed above, the top sliding door can be closed or opened. In the open position, it can be slid to either side of the boat. To set the door in the desired position, a handle 32 is attached to each side of the top sliding door. FIG. 15 is a detail view of one of the handles 32 on the top sliding door used for opening and closing the top sliding door.

Figure 17:
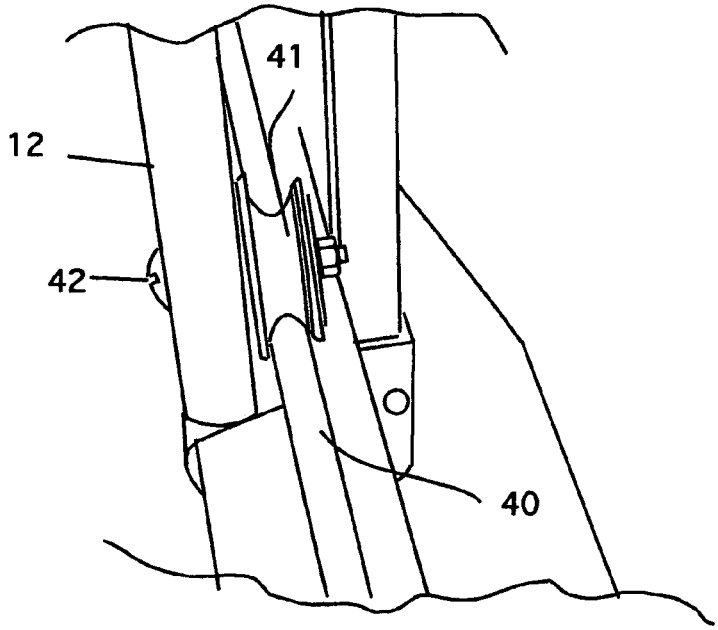
FIG. 17 is a detail view of the side door sliding system.

As mentioned above, there is a rear sliding door that is used for entry and exit of the boat. The door is slid on a similar system to that of the top sliding door. FIG. 17 is a detail view of the side door sliding system. Here, instead of a hoop, a flat rod 40 is used. The rod 40 installed along the top of the gunwale on each side of the boat. Two pulleys 41 are secured to each side of the sliding door (two on each side of the boat, fore and aft). The pulleys are secured by bolts and nuts 42. As before, the door slides along the rail on the pulley.

Note that any door or cover can be operated at any time without interfering with the opening or closing of any of the other doors or covers.

Figure 18:
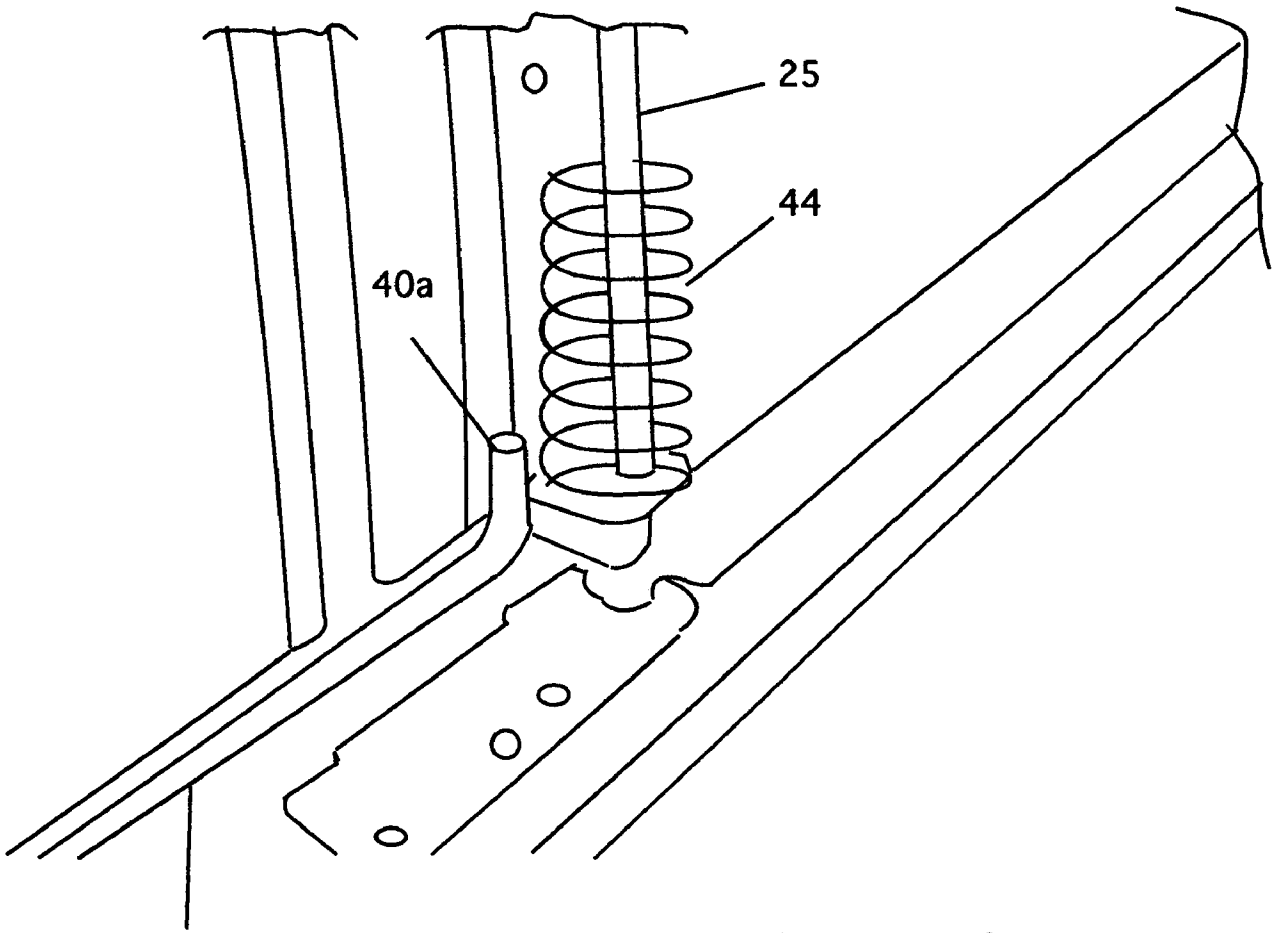
FIG. 18 is a detail view of the stops for the side door and top sliding door.

FIG. 18 is a detail view of the stops for the side door and top sliding door. In this view, the forward end 40*a* of the rod 40 is shown. Note that the end 40*a* is turned up. This acts as a stop for the door. Note also that this figure also shows the stop for the top sliding door 15, an end of the hoop 25 is shown where it secured to the hull. At the base of the hoop is a spring 44. The spring 44 acts as a shock absorber for the top sliding door when it is opened. In this way, the door 15 slides to a gentler landing when opened. Note that springs are installed on the ends of both hoops.

Figure 19:
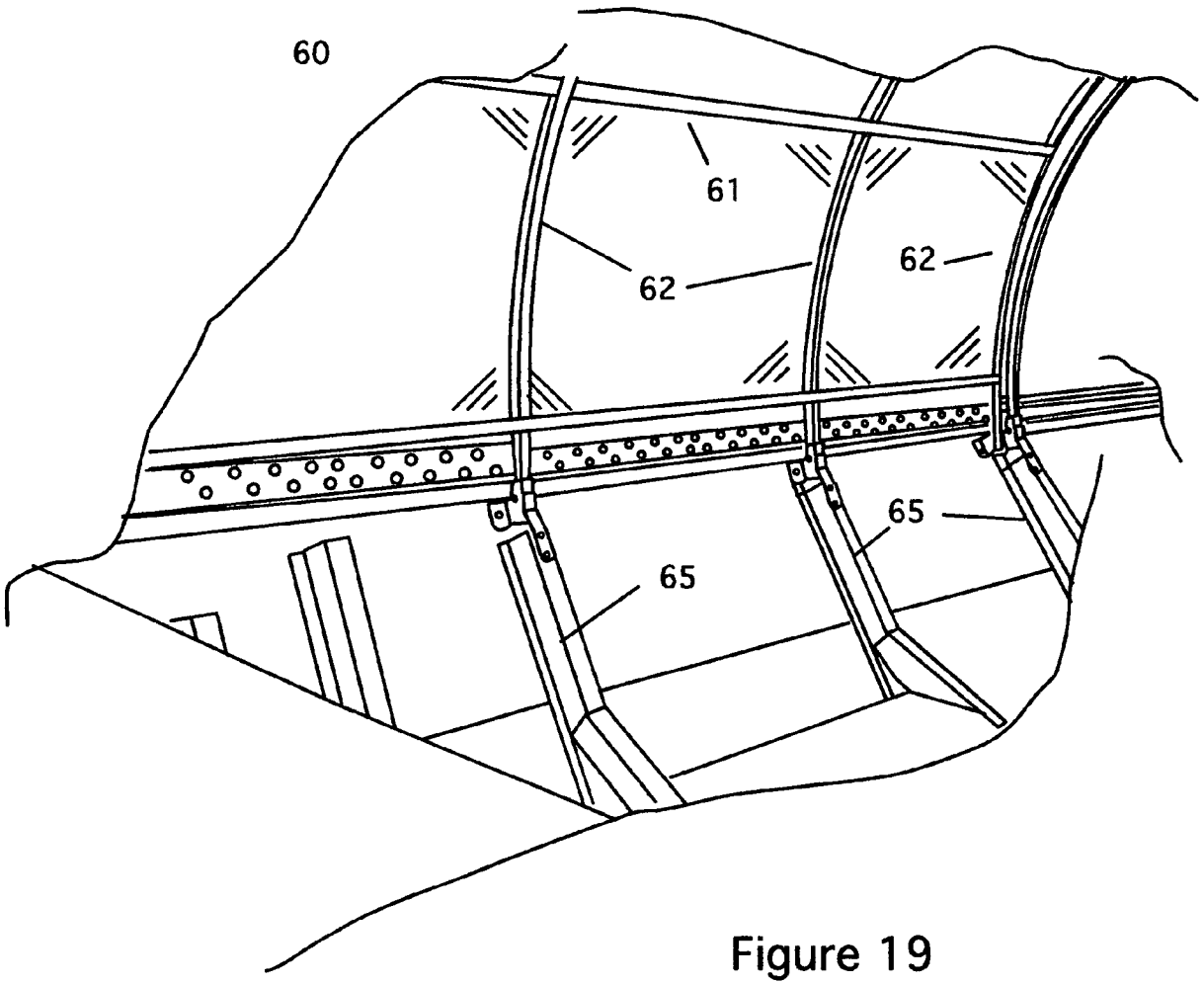
FIG. 19 is a detail of one of the frame mounting brackets.
Figure 20:
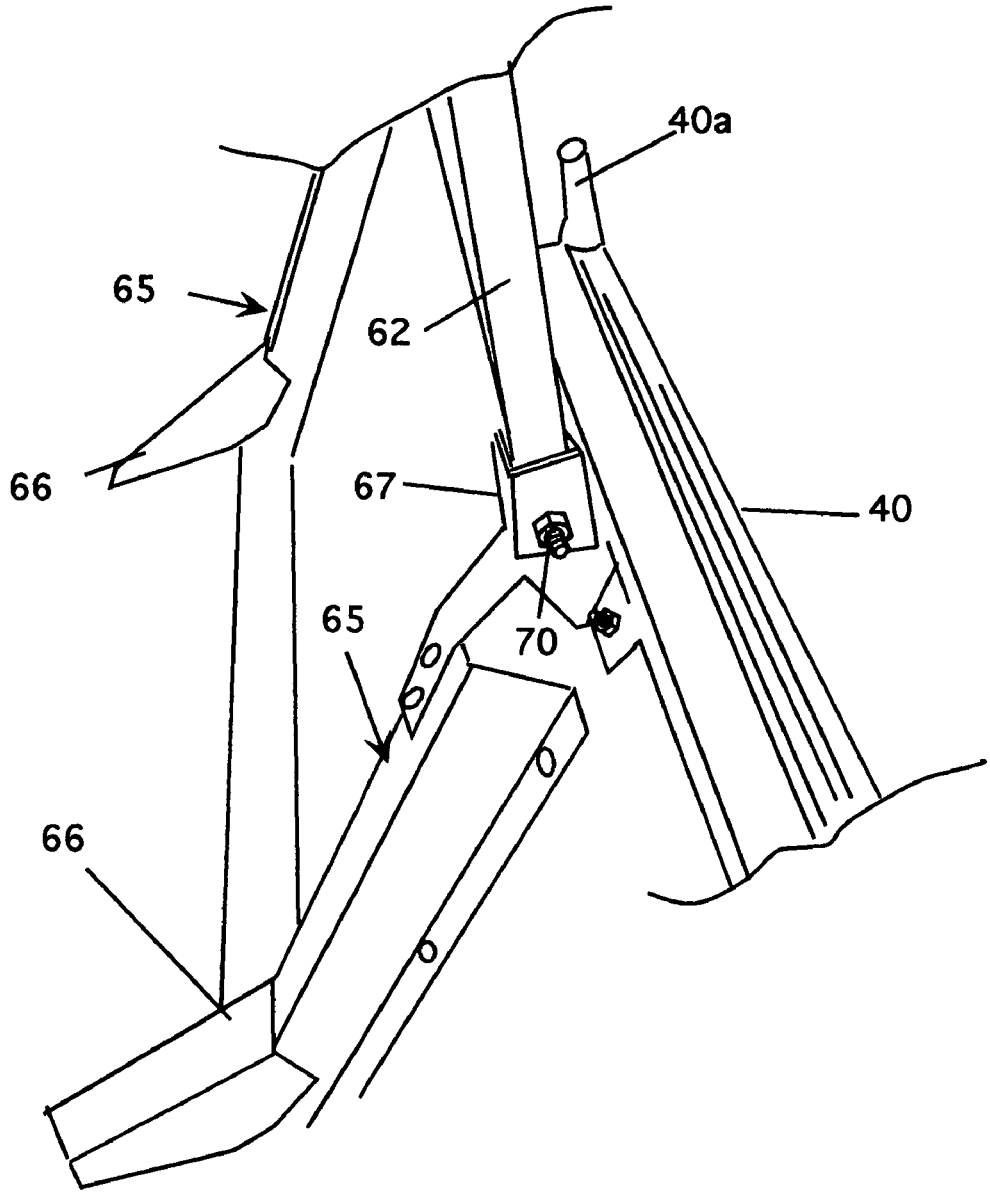
FIG. 20 is a detail of the unit installed in the frame mounting brackets.

FIGS. 19 and 20 show details of the blind mounting brackets 50. The blind is designed to the installed on and removed from the boat with a minimum of tools. This is accomplished by installed a number of mounting brackets along the sides of the inner hull of the boat. FIG. 20 is a detail of one of the frame mounting brackets. FIG. 19 shows a side of the blind. Note that like the clamshell covers, it has a skin 60 that is reinforced by a number of horizontal frame members 61 and vertical frame members 62. The brackets 65 are installed in the boat to align with the vertical members 62 as shown. These vertical members then fit into openings in the brackets 65 where they are secured. FIG. 20 shows a detail of one of the brackets 65. It has a shaped frame member 66 that is secured to the hull by rivets, welding or other fasteners. At the top of the bracket is a mounting receptacle 67. This receptacle 67 has a socket that accepts the vertical frame member as shown. A bolt and nut 70 secured each vertical frame member to the receptacle. In this way, the blind can be quickly installed on and removed from the boat as desired.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A hunting blind for mounting on a boat having a gunwale, a bow, a stern and a motor comprising:

a) a shell having an open top, a front, a back, a right side and a left side, removably secured to said gunwale;

b) a top cover, slidably attached to said shell;

c) a pair of removable clamshell covers;

d) a means for hingably securing said pair of clamshell covers to the bow of said boat;

e) a netting fixedly attached to the back of said shell; and f) a means for temporarily securing said netting in a stored position, attached to said back of said shell, whereby when said means for temporarily securing said netting in a stored position are engaged, said netting is in a rolled stored position and when said means for temporarily securing said netting in a stored position are disengaged, said netting can be deployed over the stern and motor of said boat.

2. The hunting blind of claim 1 wherein said netting is camouflaged.

3. The hunting blind of claim 1 further comprising an access door, slidably attached to said shell.

4. The hunting blind of claim 1 further comprising a means for opening and closing said pair clamshell covers when said pair of clamshell covers are secured to the bow of the boat.

5. The hunting blind of claim 4 wherein the means for opening and closing said pair clamshell covers when said pair of clamshell covers includes a pair of handles, removably attached to said pair of clamshell doors.

6. The hunting blind of claim 1 wherein said pair of clamshell covers has at least one view port installed in said pair of clamshell covers.

7. The hunting blind of claim 1 wherein said top cover is attached to a pair of tracks.

8. The hunting blind of claim 7 wherein when said top cover is slid on said pair of tracks, it has a range of motion extending from the right side of said shell to the left side of said shell.

9. The hunting blind of claim 8 wherein when said top cover is slid on said pair of tracks to one side of said shell, the open top of said shell is accessible for viewing or shooting.

10. The hunting blind of claim 8 further comprising a means for stopping the movement of said top cover on said pair of tracks.

11. The hunting blind of claim 1 wherein the shell is camouflaged.

* * * * *